US012796847B2

(12) United States Patent
Biczó et al.

(10) Patent No.: US 12,796,847 B2
(45) Date of Patent: Nov. 17, 2026

(54) SYSTEM OF A LID AND AN AROMA CONTAINER AND DRINKING DEVICE

(71) Applicant: air up group GmbH, Munich (DE)

(72) Inventors: Andràs Biczó, Hamm (DE); Peter Britz, Hamm (DE); Susanne Lengyel, Lippstadt (DE); Judith Maja Pütter, Soest (DE); Robert Schneider, Lippstadt (DE); Fabian Schlang, Munich (DE)

(73) Assignee: air up group GmbH, Munich (DE)

( * ) Notice: Subject to any disclaimer, the term of this patent is extended or adjusted under 35 U.S.C. 154(b) by 32 days.

(21) Appl. No.: 18/836,622

(22) PCT Filed: Feb. 9, 2023

(86) PCT No.: PCT/EP2023/053182
§ 371 (c)(1),
(2) Date: Aug. 7, 2024

(87) PCT Pub. No.: WO2023/152216
PCT Pub. Date: Aug. 17, 2023

(65) Prior Publication Data

US 2025/0151936 A1 May 15, 2025

(30) Foreign Application Priority Data

Feb. 9, 2022 (DE) ..... 202022000335.8

(51) Int. Cl.
*A47G 19/22* (2006.01)

(52) U.S. Cl.
CPC ..... *A47G 19/2272* (2013.01); *A47G 2400/04* (2013.01)

(58) Field of Classification Search
CPC ..... A47G 19/2272; A47G 2400/04; A47G 19/2205; A47G 400/04; A47G 21/183;
(Continued)

(56) References Cited

U.S. PATENT DOCUMENTS 3,043,464 A 7/1962 Cerasari
3,717,476 A 2/1973 Harvey
(Continued)

FOREIGN PATENT DOCUMENTS

CA 3 240 653 A1 6/2023
CN 2389124 Y 7/2000
(Continued)

OTHER PUBLICATIONS

International Search Report and Written Opinion dated Apr. 26, 2023, in connection with International Application No. PCT/EP2023/053182.
(Continued)

*Primary Examiner* — King M Chu
(74) *Attorney, Agent, or Firm* — Fish & Richardson P.C.

(57) ABSTRACT

A drinking system comprises a lid and an aroma container. The lid is attachable to the opening of a drinking vessel having an interior volume for a drinking liquid. The lid also has a transport channel for the drinking liquid leading to a drinking opening and an attachment structure for attaching the aroma container to the lid. The aroma container has a first wall, a second wall essentially parallel to the first wall, at least one sidewall connecting the first wall and the second wall, an air inlet opening and an air outlet opening. The lid has an aroma channel with a first end and a second end. The aroma channel is arranged and configured such that aromatized air leaving the air outlet opening enters the aroma channel through the first end, and leaves the aroma channel through the second end which is in communication with an opening into the transport channel for the drinking liquid.

19 Claims, 12 Drawing Sheets

(58) Field of Classification Search
CPC ..... A47G 19/12; A47G 19/122; A47G 21/18; B65D 2203/12; B65D 47/32; B65D 47/0847; B65D 43/00046; B65D 47/06; B65D 51/28; B65D 51/24; B65D 47/265
USPC ..... 220/713, 521, 719; 99/323, 322
See application file for complete search history.

(56) References Cited

U.S. PATENT DOCUMENTS

| | | | | |
|---|---|---|---|---|
| 4,955,503 | A | 9/1990 | Propes | |
| 5,165,603 | A | 11/1992 | Hahn | |
| 5,635,229 | A | 6/1997 | Ray | |
| 6,045,833 | A | 4/2000 | Landau | |
| 6,076,450 | A * | 6/2000 | DiGiorgio, Jr. | A47J 31/02 99/298 |
| 6,112,749 | A | 9/2000 | Hall et al. | |
| 6,314,866 | B1 * | 11/2001 | Melton | B65D 85/816 426/433 |
| 6,502,712 | B1 | 1/2003 | Weber-Unger | |
| 6,578,726 | B1 * | 6/2003 | Schaefer | B65D 47/265 220/717 |
| 6,932,231 | B2 | 8/2005 | Haynes et al. | |
| 7,005,152 | B2 | 2/2006 | Landau | |
| 8,272,532 | B2 | 9/2012 | Michaelian et al. | |
| 8,662,294 | B2 | 3/2014 | Benbassat | |
| 8,662,339 | B2 * | 3/2014 | Sprunger | B65D 51/18 220/521 |
| 9,010,238 | B2 | 4/2015 | Bodum | |
| 9,795,242 | B2 | 10/2017 | Waggoner et al. | |
| 9,968,209 | B2 | 5/2018 | Maranon | |
| 10,328,172 | B2 | 6/2019 | Griffis | |
| 11,564,516 | B2 | 1/2023 | Jäger et al. | |
| 11,793,336 | B2 | 10/2023 | Jäger et al. | |
| 12,232,639 | B2 | 2/2025 | Jüngst et al. | |
| 2001/0042546 | A1 | 11/2001 | Umeda et al. | |
| 2002/0036239 | A1 | 3/2002 | Banach | |
| 2004/0261807 | A1 | 12/2004 | Dube et al. | |
| 2007/0062961 | A1 | 3/2007 | Rigas | |
| 2007/0088314 | A1 | 4/2007 | Gollier | |
| 2008/0000898 | A1 * | 1/2008 | Ramsden | B65D 51/28 220/521 |
| 2008/0028353 | A1 | 1/2008 | Lu et al. | |
| 2008/0128427 | A1 | 6/2008 | Friedman | |
| 2008/0230079 | A1 | 9/2008 | Besso et al. | |
| 2008/0257853 | A1 | 10/2008 | Cappello | |
| 2009/0250479 | A1 | 10/2009 | Kaufman et al. | |
| 2009/0266829 | A1 | 10/2009 | Bailey | |
| 2011/0094904 | A1 | 4/2011 | Lee | |
| 2011/0155732 | A1 | 6/2011 | Sprunger | |
| 2012/0261375 | A1 * | 10/2012 | Loging | A61J 7/0046 215/11.4 |
| 2013/0302477 | A1 | 11/2013 | Salinas | |
| 2014/0166680 | A1 | 6/2014 | St. Gelais | |
| 2015/0030726 | A1 | 1/2015 | Binder et al. | |
| 2016/0046407 | A1 | 2/2016 | Lee | |
| 2017/0239382 | A1 | 8/2017 | Griffis | |
| 2018/0000269 | A1 | 1/2018 | San Miguel et al. | |
| 2018/0147484 | A1 | 5/2018 | Osawa et al. | |
| 2019/0367230 | A1 | 12/2019 | Griffis | |
| 2020/0178712 | A1 | 6/2020 | Jager et al. | |
| 2022/0087456 | A1 | 3/2022 | Jager et al. | |
| 2023/0270270 | A1 | 8/2023 | Magdalena et al. | |
| 2023/0312197 | A1 | 10/2023 | Jungst et al. | |
| 2025/0009155 | A1 | 1/2025 | Jäger et al. | |
| 2025/0151936 | A1 | 5/2025 | Biczó et al. | |
| 2025/0169633 | A1 | 5/2025 | Jungst et al. | |

FOREIGN PATENT DOCUMENTS

| | | | |
|---|---|---|---|
| CN | 2461872 | Y | 11/2001 |
| CN | 101578053 | A | 11/2009 |
| CN | 106820859 | A | 6/2017 |
| CN | 206380892 | U1 | 8/2017 |
| DE | 20 2016 004 961 | U1 | 9/2016 |
| DE | 20 2017 000 239 | U1 | 1/2017 |
| DE | 20 2018 000 382 | U1 | 5/2018 |
| DE | 10 2018 003 669 | A1 | 1/2019 |
| DE | 10 2018 222 299 | A1 | 6/2020 |
| DE | 20-2020-102807 | U1 | 8/2021 |
| DE | 20 2021 101 790 | U1 | 7/2022 |
| DE | 20 2023 102 688 | U1 | 6/2023 |
| EP | 1 056 660 | A1 | 3/2005 |
| EP | 2 215 936 | A1 | 8/2010 |
| EP | 2 496 118 | B1 | 10/2013 |
| EP | 3 944 792 | A1 | 2/2022 |
| EP | 944 792 | A1 | 2/2022 |
| EP | 4 321 061 | A1 | 2/2024 |
| GB | 2 401 527 | A | 11/2004 |
| JP | S52-070583 | U | 11/1950 |
| JP | S56-101090 | U | 12/1954 |
| JP | H02-100480 | U | 8/1990 |
| JP | H02-274252 | A | 11/1990 |
| JP | 2000-085777 | A | 3/2000 |
| JP | 2001-299916 | | 10/2001 |
| JP | 2002-037304 | A | 2/2002 |
| JP | 2004-026304 | A | 1/2004 |
| JP | 2006-520722 | A | 9/2006 |
| JP | H03-129314 | U | 2/2007 |
| JP | 2008-104557 | A | 5/2008 |
| JP | 2008-150056 | A | 7/2008 |
| JP | 2011-507771 | A | 3/2011 |
| JP | 2012-020783 | A | 2/2012 |
| JP | 2013-121556 | A | 6/2013 |
| JP | 2015-051781 | A | 3/2015 |
| JP | 2017-030791 | A | 2/2017 |
| JP | 2018-188221 | | 11/2018 |
| KR | 20-2016-0004174 | U1 | 12/2016 |
| RU | 132697 | U1 | 9/2013 |
| WO | WO 2003/013977 | A1 | 2/2003 |
| WO | WO 2016/199441 | A1 | 12/2016 |
| WO | WO 2019/016096 | A1 | 1/2019 |
| WO | WO 2019/101973 | A1 | 5/2019 |
| WO | WO 2020/054988 | A1 | 3/2020 |
| WO | WO 2020/126210 | A1 | 6/2020 |
| WO | WO 2021/233516 | A1 | 11/2021 |
| WO | WO 2022/111808 | A1 | 6/2022 |
| WO | WO 2022/184823 | A1 | 9/2022 |

OTHER PUBLICATIONS

International Preliminary Report on Patentability dated Aug. 6, 2024, in connection with International Application No. PCT/EP2023/053182.

Galileo, "Wie reines Leitungswasser plötzlich Geschmack bekommt. Galileo. ProSieben" Youtube, Mar. 12, 2018 (Mar. 12, 2018), pp. 1-1, Retrieved from the Internet: https://www.youtube.com/watch?v=SiCL5J7_TMA [retrieved on Feb. 21, 2020].

Hrfernsehen "Serie: Hessen innovativ—Joyce" YouTube, Dec. 5, 2017 (Dec. 5, 2017), pp. 1-1, Retrieved from the Internet: https://www.youtube.com/watch?v=1AfLGzcoRN8 [retrieved on Feb. 21, 2020].

International Search Report and Written Opinion for International Application No. PCT/EP2018/069108, mailed Oct. 23, 2018, with English translation thereof.

International Preliminary Report on Patentability for International Application No. PCT/EP2018/069108, mailed Jan. 21, 2020, with English translation thereof.

International Search Report and Written Opinion for International Application No. PCT/EP2019/080708, mailed Mar. 5, 2020, with English translation thereof.

International Search Report and Written Opinion mailed Feb. 19, 2021, in connection with International Application No. PCT/EP2020/063793.

International Search Report and Written Opinion dated Sep. 28, 2021, in connection with International Application No. PCT/EP2021/070240.

International Search Report and Written Opinion mailed Oct. 23, 2023, for International Application No. PCT/EP2023/071697.

(56) References Cited

OTHER PUBLICATIONS

International Search Report and Written Opinion dated May 2, 2023, in connection with International Application No. PCT/EP2023/053361, with English translation thereof.

* cited by examiner

SYSTEM OF A LID AND AN AROMA CONTAINER AND DRINKING DEVICE

RELATED APPLICATIONS

This application is a national stage filing under 35 U.S.C. § 371 of international application number PCT/EP2023/053182, filed Feb. 9, 2023, which claims the benefit of German application number DE 20 2022 000 335.8, filed Feb. 9, 2022, each of which is herein incorporated by reference in its entirety.

FIELD OF THE INVENTION

The invention relates to a system of a lid and an aroma container as well as a drinking device with such system.

PRIOR ART

There is an increasing need to ingest drinking liquids which on the one hand have a pleasant flavor but on the other prevent health risks which could be brought about by the ingestion of aroma substances or stabilizing agents dissolved in the drinking liquid. The ingestion of an increased quantity of calories is also to be avoided.

Water which has been given a slightly fruity aroma has therefore become popular in the last few years. However, undesired additives, such as stabilizing substances and a certain amount of sugar, are also contained in this aromatized water. Many users reject such drinks simply on account of this number of calories and dental hygiene.

Since the olfactory sensation plays a significant part in gustatory perception in the consumption of food and beverages, drinking systems to date have attempted to influence the smell perceived while drinking. To that end, aroma elements are proposed which can be attached close to the drinking opening on a drinking vessel so that the aroma element is in the immediate proximity of the nose of the user, who breathes through the nose while drinking and thereby perceives the aroma.

A drinking device for retronasal ingestion of an aroma substance, comprising an aroma container through which air can flow and which supplies aromatized air to a transport channel for drinking liquid, is known from WO 2019/016096 A1. In this way, the aroma substance is ingested retronasally. During drinking, the aroma substance reaches the mouth of the user together with the drinking liquid and subsequently rises retronasally via the pharynx to the olfactory mucosa, where it is detected by the receptors situated there and is perceived by the user. Advantage is taken of the fact that there is a close correlation between the sense of smell and the sense of taste. The user therefore gains the impression that they are tasting the aroma, even though they are in fact only smelling it retronasally.

DESCRIPTION OF THE INVENTION

The invention is based on the object of proposing a system of a lid and an aroma container which is attachable to a conventional drinking vessel.

This object is solved by a system of a lid and an aroma container with the features of claim 1 as well as a drinking device with the features of claim 15. Preferred embodiments are apparent from the other claims.

In the system of an attachment, preferably a lid, and an aroma container the lid has means for attaching the lid to the opening of a drinking vessel having an interior volume for a drinking liquid. The lid also has a transport channel for the drinking liquid leading to a drinking opening and an attachment structure for attaching the aroma container to the lid. The aroma container has a first wall, a second wall essentially parallel to the first wall, at least one sidewall connecting the first wall and the second wall, an air inlet opening and an air outlet opening. The lid has an aroma channel with a first end and a second end, the aroma channel being arranged and configured such that aromatized air leaving the air outlet opening of the aroma container enters the aroma channel through the first end, and leaves the aroma channel through the second end, the second end of the aroma channel being in communication with an opening into the transport channel for the drinking liquid.

The system provides inter alia a convenient manner by which a user can experience scent-based taste when using a wide range of different drinking vessels and without needing to use any kind of straw.

Preferably, the lid further comprises a second aroma channel, the second aroma channel having a first end for the inlet of air from the surroundings and a second end being in communication with the air inlet opening of the aroma container. This aroma channel enables the convenient inlet of air into the aroma container and by providing a dedicated aroma channel in the lid reduces the risk of unwanted foreign objects entering the aroma container.

Preferably the first aroma channel is arranged in a main body part of the lid, preferably wherein the second aroma channel is arranged in the attachment structure of the lid. The separation of the aroma channels in such a manner helps to prevent cross contamination of the aroma channels, as well as providing an optimal flow path through the aroma container to ensure that as much flavour is absorbed in the air that passes through the aroma container as possible.

Preferably the first and second aroma channels are arranged substantially parallel to one another, preferably substantially in the same horizontal plane as one another. This helps to provide optimal flow of air through the system by having the aroma channels aligned in this manner.

Preferably the lid has a single opening configured to permit liquid to exit the drinking vessel. This reduces significantly the risk of leakage of drinking fluid out of the device, particularly when the device is not in use and is being transported for example. Since the device is a tilt device, it also prevents drinking liquid exiting the vessel through unwanted exits/access points.

Preferably the aroma container has an outer sidewall and an inner sidewall adapted to a shape of the attachment structure of the lid, wherein in the attached state of the aroma container on the lid the attachment structure extends through a space surrounded by the inner sidewall. This configuration enables the aroma container to be attached to the attachment structure in a convenient manner and easily permit the inflow/outflow of air through the aroma container.

Preferably the air inlet opening is arranged on the inner sidewall of the aroma container and the air outlet opening is arranged on the second wall which is located on the underside of the aroma container. This arrangement of the inlet/outlet has been found to provide good air flow through the aroma container and allow for a wider variety of designs of the lid component.

Preferably the attachment structure comprises a receiving channel for the inlet of air from the surrounding atmosphere to the air inlet opening of the aroma container. The receiving channel arranged in this manner ensures a convenient way for air to enter into the aroma container.

Preferably the lid further comprises a first closure having a main body with an air inlet opening, the first closure being moveably attached to the lid main body and being moveable between an open position and a closed position in which the first closure covers the aroma container such that the receiving channel is aligned with the air inlet opening. The first closure helps to prevent anything unwanted entering the receiving section which contains the aroma container, while not obstructing the inflow of air into the aroma container during normal use.

Preferably the lid further comprises a second closure moveably connected to the lid, such that the second closure is moveable between a closed position and an open position, preferably wherein the second closure further comprises a distal lip configured to block the drinking opening in the closed position. The second closure blocks anything unwanted from entering into the internal compartments of the lid or anywhere else. In particular, the second closure helps to block the drinking opening and to seal it, which prevents anything entering or leaving the drinking vessel via the drinking opening. This ensures that the drinking device does not leak during transport, for example.

Preferably the second closure further comprises a plug configured to simultaneously block the receiving channel in the closed position. This ensures that no air can enter into the receiving channel, which seals the inlet of air into the aroma container and prevents air from travelling into the aroma container. This helps to preserve the lifetime of the flavouring inside the aroma container by ensuring that air cannot enter the aroma container when the user is not using the drinking device.

Preferably the transport channel is located at or proximal to the attachment means, preferably wherein the entire transport channel is located proximal to the attachment means. This removes the need for there to be a straw in the drinking system and provides a convenient manner by which the user can drink drinking liquid which has recently mixed with flavoured air.

Preferably the lid is attachable to drinking vessels with different sizes of vessel opening. This provides the advantage that the system can be used on a wide range of drinking vessels, which is convenient for the user.

Preferably, the attachment structure is configured to allow a defined relative movement between the aroma container and the lid, wherein the aroma container is movable between at least two different operational positions.

In such a way, an activated position can be defined in which the air outlet opening of the aroma container is in flow communication with the aroma channel of the lid. The movement of the aroma container between the activated position and a non-activated position extends the service life of the aroma container since there is no unintentional evaporation of aroma substance when it is not in operation. The movement of the aroma container between the non-activated position and the activated position can be performed by the user themselves so that the drinking device according to the invention can also be used to consume non-aromatized drinking liquid.

In the simplest case, the movement of the aroma container, which is preferably a translational movement, can establish or interrupt the flow connection between the air outlet opening of the aroma container and the aroma channel of the lid.

The translational movement is preferably essentially perpendicular to the first wall of the aroma container.

Likewise, the aroma container and the attachment can also be designed such that a rotational relative movement between the lid and the aroma container can be performed. In this case, the relative movement is a rotational movement within a plane essentially defined by the first wall of the aroma container.

The inner sidewall of the aroma container can be adapted to the shape of the fixing protrusion of the lid such that the fixing protrusion of the lid fully conforms to the shape of the inner sidewall such that a relative rotational movement between the aroma container and the lid is prevented. Such configuration has the advantage that it is possible to design the system of the attachment and the aroma container such that the aroma container can only be attached to the attachment structure in a well-defined rotational orientation so that an erroneous wrong attachment by a user can be prevented. The situation according to which the fixing protrusion of the lid and the inner sidewall of the aroma container are shaped so that the aroma container can be attached to the lid in a single rotational orientation of the aroma container is a specific case of the shape of an inner sidewall adapted to the shape of a fixing protrusion of the lid. More generally, the inner sidewall of the aroma container and the outer shape of the fixing protrusion can also be designed such that a well-defined relative rotational movement between the aroma container and the fixing protrusion is possible so that a defined rotational movement between an activated position and a non-activated position is possible.

In general, the inner sidewall of the aroma container and the fixing protrusion of the lid can also be shaped such that no relative rotational movement between the aroma container and the fixing protrusion is possible, while there is only a contact between the inner sidewall of the aroma container and the fixing protrusion in defined regions. Specific portions at which the inner sidewall of the aroma container and the fixing protrusion do not contact each other can be used for other purposes, like the provision of a possible air inlet between the fixing protrusion and the inner sidewall of the aroma container, or in order to generate a defined frictional force to surmount when moving the aroma container relative to the fixing protrusion. Such frictional force is governed by the size of the contact area between aroma container and fixing protrusion.

According to a preferred embodiment, the lid is essentially made from renewal raw materials in order to provide a product with a high sustainability.

According to an alternative, preferred embodiment, the lid is made from plastic material free of Bisphenol A.

As a further preferred alternative, the lid can be made of a food-safe plastic material.

There is also provided a drinking device comprising a drinking vessel attached to the system of a lid and an aroma container according to the aspect and preferred embodiments provided above.

According to a further aspect of the invention, a system of a lid and an aroma container is provided, wherein the lid is a ring configured to be attachable to a drinking vessel with an interior volume for a drinking liquid and a drinking opening at or close to an upper end of the drinking vessel, and comprises means for fixing the ring to the drinking vessel, a drinking straw attachable to the ring with a transport channel for the drinking liquid, and an attachment structure for attaching the aroma container to the ring, wherein the aroma container has a first wall, a second wall essentially parallel to the first wall, at least one sidewall, an air inlet opening and an air outlet opening. The ring comprises an aroma channel with a first end and a second end, the aroma channel being arranged and configured such that aromatized air leaving the air outlet opening of the aroma container enters the aroma channel through the first end, and leaves the aroma channel through the second end, the second end of the aroma channel being in communication with an entry opening into the transport channel for the drinking liquid.

This is another possible configuration of the system of a lid and an aroma container with a drinking straw. When fixing the lid to the drinking vessel, a user can suck in liquid which will become aromatized by adding aromatized air to the liquid leaving the drinking outlet arranged at the end of the drinking straw.

According to this aspect of the invention, the lid structure is a ring. In other words, the drinking vessel is not closed at or close to its drinking opening, but a ring is fixed to the drinking vessel, wherein a drinking straw and an aroma container are fixed to the ring. The ring has the additional function to be provided with an aroma channel which is arranged and configured such that aromatized air leaving the air outlet opening of the aroma container enters the aroma channel and leaves it through a second end which is in communication with an entry opening into the transport channel for the drinking liquid within the drinking straw.

According to a preferred embodiment, the attachment is attachable to drinking vessels with different sizes of the drinking opening.

This can be realized by a continuous conical or stepped conical shape of an attachment structure between the lid or ring and the shape of the inner rim of the drinking opening.

In a third aspect, there is provided a drinking system, the drinking system comprising a drinking vessel comprising an opening for drinking and a second opening for attachment to an attachment structure; and the attachment structure, wherein the attachment structure is connected to an annular aroma container having an air inlet to allow air to enter the aroma container and an air outlet to allow flavoured air to exit the aroma container and a drinking straw positioned through the interior annular portion of the aroma container, the air outlet and drinking straw being arranged such that flavoured air exiting the air outlet enters the internal chamber of the drinking straw.

In this aspect there is a plurality of drinking openings, and the attachment is attachable at or close to one of the drinking openings of the drinking vessel. In such a way, the user can select whether he/she wants to drink directly from the drinking vessel, i.e. drinking liquid without added aromatized air, or wants to drink through another drinking opening including aromatized air.

Preferably, the drinking opening is surrounded by a rim not arranged in a single plane. When using such specific shape, the drinking opening can be arranged at a higher level as compared to the remaining parts of the lid. Likewise, it is also possible to arrange e.g., a drinking straw at a position of the lid which is lower than that of a further drinking opening from which a user can drink directly from the container.

According to a preferred embodiment, the aroma container is arranged such that its first wall and second wall are essentially perpendicular to the drinking opening of the drinking vessel.

In such a way, the aroma container can be arranged in a most space-efficient way on the drinking vessel.

BRIEF DESCRIPTION OF THE DRAWINGS

In the following, several embodiments will be described with reference to the drawings. In the drawings

DETAILED DESCRIPTION OF PREFERRED EMBODIMENTS

Figure 1:
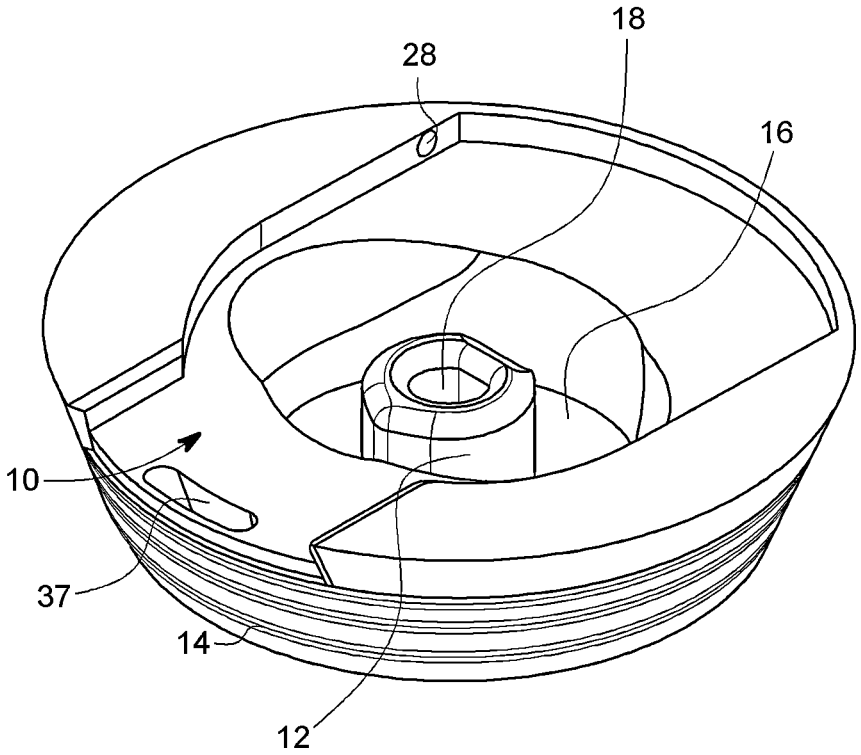
FIG. 1 shows the main body of an attachment of an inventive system.

Throughout the embodiments, the same structural elements will be denoted by the same reference numerals.

In FIG. 1, a lid with a lid main body 10 is shown. The lid main body 10 is configured to be attachable to a drinking vessel at or close to an upper end of the drinking vessel. It is provided with a fixing means 14 for fixing the lid to the interior circumference of a rim surrounding an opening of the drinking vessel. The fixing means 14 is typically flexible in order to allow the lid main body 10 to be fixable to drinking vessels with slightly different sized vessel openings. As shown in FIG. 1, the fixing means 14 typically consists of a plurality of circumferential ribs (preferably 3 ribs), which enable a better fit with a wider range of drinking vessel opening sizes. In alternative embodiments, the fixing means 14 can include or be operable together with an expansion means (not shown in FIG. 1) which enables the fixing means 14 to be expanded or contracted in size so as to enable to the lid main body 10 to fit to different sized vessel openings. Such expansion means can include a dial or nob which can be operated (twisted or otherwise activated) to cause an expansion member to physically expand or contract the circumference of the fixing means 14. This is convenient for the user since the lid main body 10 can then be used on a wide range of drinking vessels which have different sized vessel openings.

Further, the lid main body 10 is provided with an attachment structure 12 for attaching an aroma container (not shown in FIG. 1). As can be seen in FIG. 1, the attachment structure 12 is provided in a reception space 16 for the aroma container and protrudes from a bottom wall of the reception space 16.

The reception space 16 has a shape, the outer cross-sectional of which is non-circular so that an aroma container which is essentially ring-shaped and has an inner sidewall adapted to the shape of the attachment structure 12 can only be mounted to the lid main body 10 in a defined relative rotational position.

Further, the attachment structure 12 is provided with a receiving channel 18 for allowing the introduction of air from the surrounding atmosphere to enter into the aroma container. The receiving channel 18 is an inner channel within the attachment structure 12, which is arranged within the attachment structure 12 in a longitudinal manner, and preferably extends the enter longitudinal length of the attachment structure 12.

Figure 2:
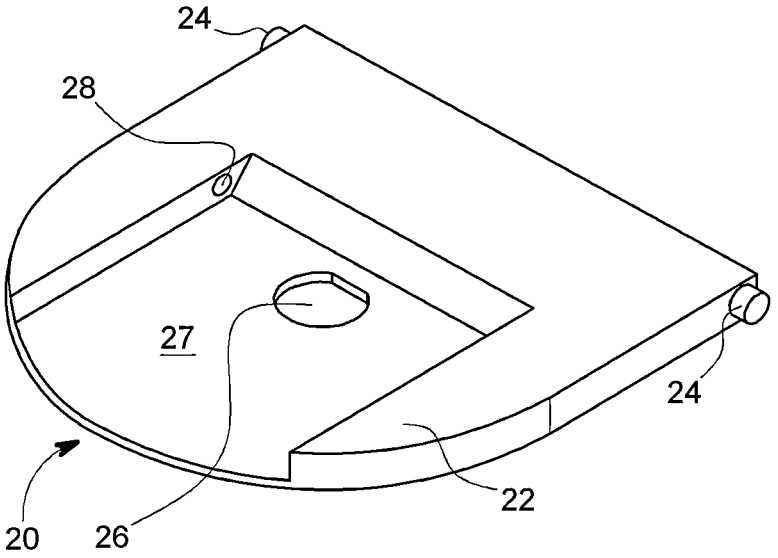
FIG. 2 shows a first closure for closing a reception space for an aroma container in an attachment according to FIG. 1.
Figure 3:
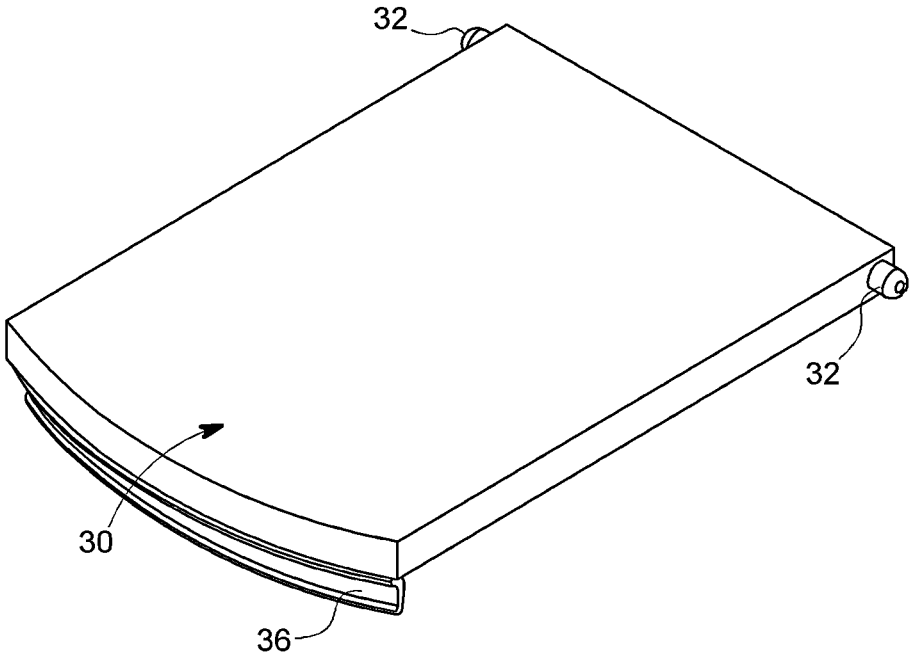
FIG. 3 shows a second closure attachable to the first closure according to FIG. 2.

In FIG. 2, a first closure is shown which, by means of articulation pins 24 can be pivotally mounted to the lid main body 10 which is provided with receiving holes 28 for the articulation pins 24, respectively. Any other pivot attachment means would also be suitable as long as the first closure is able to pivot relative to the lid main body 10. The first closure 20 has a main body 22 with an air inlet opening 26. Further, the first closure 20 is provided with a recessed portion 27 for receiving the second closure 30 as shown in FIG. 3. The second closure 30 is provided with second articulation pins 32 to protrude into the receiving holes 28 of the first closure 20 so that the second closure 30 can be articulated between an open position uncovering the recessed portion 27 and the air inlet opening 26, and a closed position in which the air inlet opening 26 for air is closed. In order to fix the second closure 30 in the closed position, it can be provided with a fixing clip 36 cooperating with the lid main body 10 such that the second closure 30 can be fixed in the closed position. The fixing clip 36 is configured to simultaneously hold the second closure 30 in the closed position and also prevent the leakage of liquid from drinking opening 37. Fixing clip 36 seals the liquid transport channel 35 at the drinking opening 37 by inserting itself into the drinking opening 37 and thus prevents the flow of drinking fluid out of the drinking opening 37 and prevents leakage from occurring when the user wants to transport the drinking system, for example. It is to be understood that any other pivoting means or closure means may be usable in accordance with this embodiment such that the second closure 30 performs its functions of closing off the internal components of the device from the surrounding environment in order to keep it clean and prevent the ingress of any unwanted contaminants etc.

In order to better close the air inlet opening 26, the second closure 30 can additionally be provided with a plug 42 (see FIG. 7) which, in the closed position of the second closure 30, seals the air inlet opening 26 so that air and foreign objects are prevented from entering the air inlet opening 26 and receiving channel 18.

Figure 4:
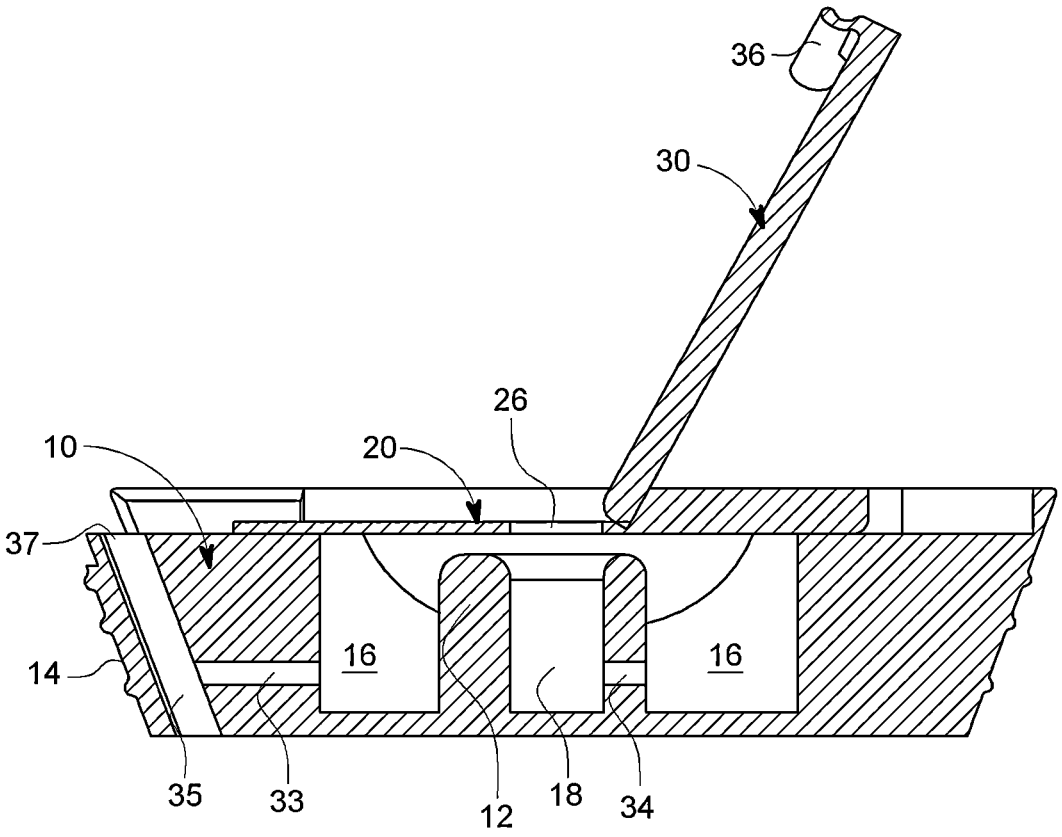
FIG. 4 is a cross-sectional view of the lid of the inventive system.

In the cross-sectional view of FIG. 4, it can be seen that there is an aroma channel 34 communicating with the reception space 16 for an aroma container. There is also an air supply duct 33, which is in communication with the reception space 16, leading from the reception space 16 to a liquid transport channel 35. There is also a drinking opening 37 of the lid whereby the user can consume liquid, such as water, via the liquid transport channel 35. The drinking opening 37 and/or liquid transport channel 35 are arranged at an outer circumference of the lid. In use, the device is attached to a drinking vessel via fixing means 14 which abut against the internal surface of the opening of the drinking vessel such that the lid remains in position through a frictional force between the fixing means 14 and the internal surface of the drinking vessel. A user then tilts the drinking vessel with the device attached thereto and typically applies a suction force to the drinking opening 37. Such action causes liquid, normally water, contained within the drinking vessel to travel via the liquid transport channel 35 and to exit via the drinking opening 37 to be consumed by a user. Also, due to a combination of the tilting action and the negative pressure applied by the user through suction, air from the atmosphere is sucked in via the receiving channel 18, through the aroma channel 34 whereby it enters into the aroma container via an air inlet aperture in the aroma container outer wall. The air then travels around the aroma container where it absorbs flavouring contained within the aroma container and exits the aroma container via an air outlet contained in the outer wall of the aroma container, and then travels via the reception space 16 and air supply duct 33 to meet with the liquid transport channel 35, whereby flavoured air bubbles become mixed with the liquid being consumed by the user, thus giving the user a retronasal based perception of taste. The device of FIG. 4 thus comprises a plurality of integral air transport channels 33,34 configured to transport air to the aroma container and then flavoured air from the aroma container to the liquid transport channel 35. Specifically, the device of FIG. 4 contains two integral air transport channels. This is in contrast to the prior art devices, which typically contain only a single continuous air transport channel, whereas the lid shown in FIG. 4 contains two separate air channels (or a single discontinuous channel) integral to the device. In particular, the air supply duct 33 is located in the lid main body 10, as opposed to being located at the suction port as in the prior art devices.

Although the aroma container is not shown in FIG. 4, the aroma container is typically the same as that of patent application no. PCT/EP2019/080708 (including an aroma inside the aroma container as described in this patent application, such as a non-woven fleece material, with aroma absorbed thereto). While the aroma container is structurally the same as that described in this previous application, the air inlet and outlet function in an opposite manner to the aroma container in this embodiment. Thus, in the present embodiment, the air inlet is on the internal circumferential wall and the air outlet is on the underside of the aroma container. Air thus travels through the aroma container in an opposite direction to that of the aroma containers typically shown in patent application no. PCT/EP2019/080708. Such an aroma container is also shown in the present application in FIGS. 8 to 13.

In preferred embodiments, the attachment structure 12 is shaped such that, when an aroma container 40 is attached thereto, the bottom of the aroma container does not reach the base/bottom of the reception space 16. This allows flavoured air to exit the aroma container via an air outlet on the underside of the aroma container and travel via air supply duct 33 to the liquid transport channel 35. Although it is to be understood that the lid and aroma container could be modified accordingly so as to enable the air inlet and outlet apertures to be positioned on other parts of the aroma container.

As can be seen from FIG. 4, the lid has only a single outlet (liquid transport channel 35 and drinking opening 37) for the liquid contained within the drinking vessel. In contrast to existing known scent-based-taste devices, the lid is designed to be used with drinking vessels by a user turning the drinking vessel with the lid attached substantially in an upside down arrangement, such that drinking liquid travels down the liquid transport channel 35 and thus does not require any use of a straw-which imparts other such restrictions on the device, such as that of a valve to allow air into the drinking vessel interior when a user sucks on the straw.

In an alternative embodiment, not shown in FIG. 4, the attachment structure 12 has a lip (first motion stopper structure) arranged towards the distal end of the attachment structure 12, which is configured to keep the aroma container in an activated position i.e., the aroma container's air inlet and outlets in communication with the corresponding transport channels of the lid. The user must overcome the frictional force of the lip in order to remove the aroma container from the lid. This prevents accidental removal of the aroma container during usage. In certain embodiments, there is a further lip (second motion stopper structure) arranged distal to the first motion stopper structure. The second motion stopper structure is configured to hold the aroma container in a deactivated position, whereby the air inlet and outlets of the aroma container are no longer in fluid communication with the associated channels of the lid since the aroma container has been vertically moved to bring the channels out of alignment. In a further alternative embodiment, the attachment structure 12 and aroma container 40 can be configured to permit a rotational movement of the aroma container around the attachment structure 12 so as to enable the user to activate and deactivate the aroma container through a rotational movement of the aroma container. Alternatively, the lid main body 10 can be made of a separate and non-integral component to that of the attachment structure 12, such that the two components are rotatable relative to one another. In this embodiment, the lid main body 10 could be rotated relative to the attachment structure 12 and aroma container 40 to bring the air supply duct 33 out of fluid communication with the aroma container and thus deactivate the aroma container i.e., prevent flavoured air entering the liquid transport channel 35.

Figure 5:
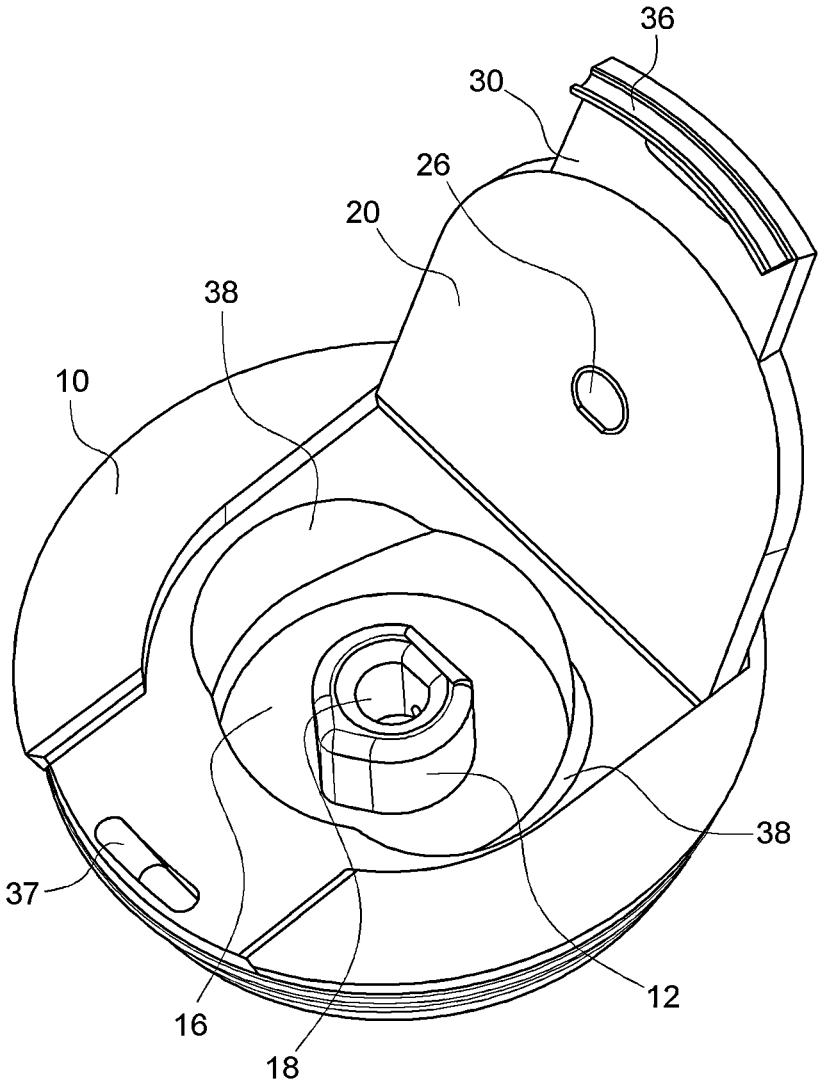
FIG. 5 is a three-dimensional view of the lid with opened first and second closures.

In the cross-sectional view of FIG. 4, the first closure 20 is closed, whereas the second closure 30 is opened. It can be seen that the first closure 20 serves to close the reception space 16 for an aroma container and only needs to be opened if a user wants to insert or remove an aroma container. This situation is shown in FIG. 5 where both the first closure 20 and the second closure 30 are opened. First closure 20 contains air inlet opening 26 to allow air to enter into the reception space 16 and thus to be able to enter the aroma container. The lid can, and should, therefore be used with first closure in the closed position.

In order to close the first closure 20 as shown in FIG. 4, an aroma container is shaped and inserted such that it is fully received within the reception space 16. In order to make it easier for a user to grasp and remove an aroma container from the reception space 16, recesses 38 may be arranged as shown in FIG. 5 which allow the insertion of a finger so that a user can easily grasp an aroma container and remove it from the reception space 16.

Figure 6:
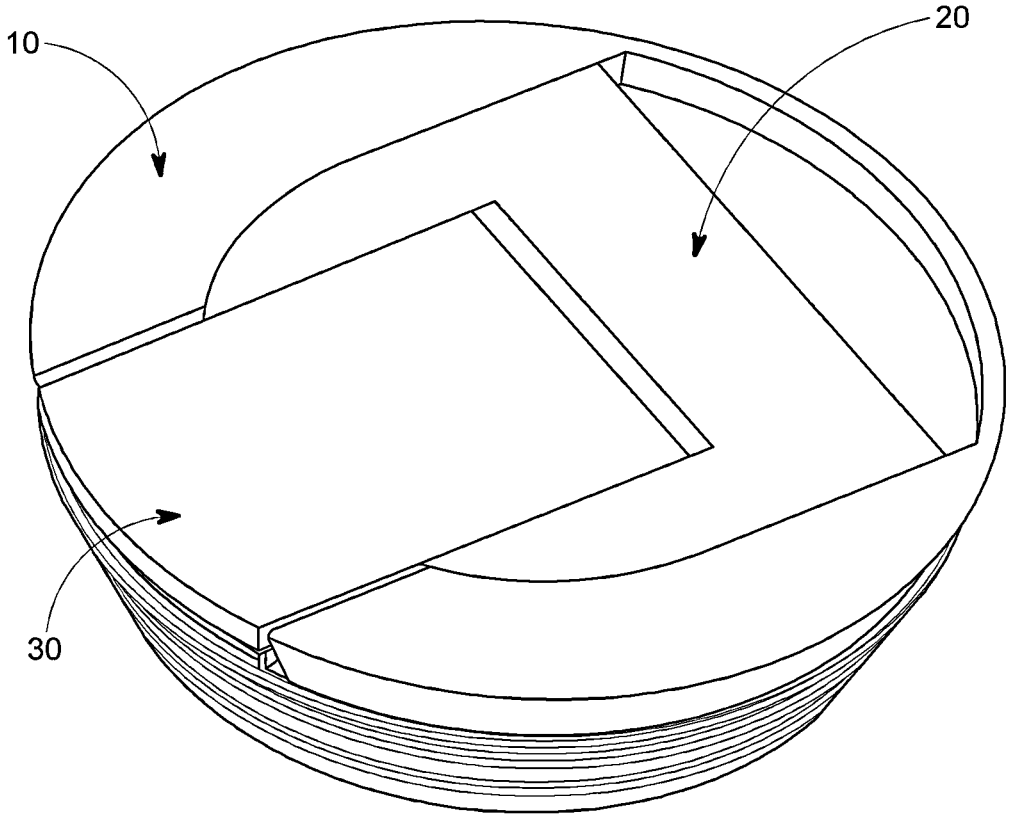
FIG. 6 is a three-dimensional view of the lid of FIG. 5 with closed first and second closures.

In FIG. 6, the attachment is shown in the closed position with both the first closure 20 and the second closure 30 closed on the lid main body 10.

Figure 7:
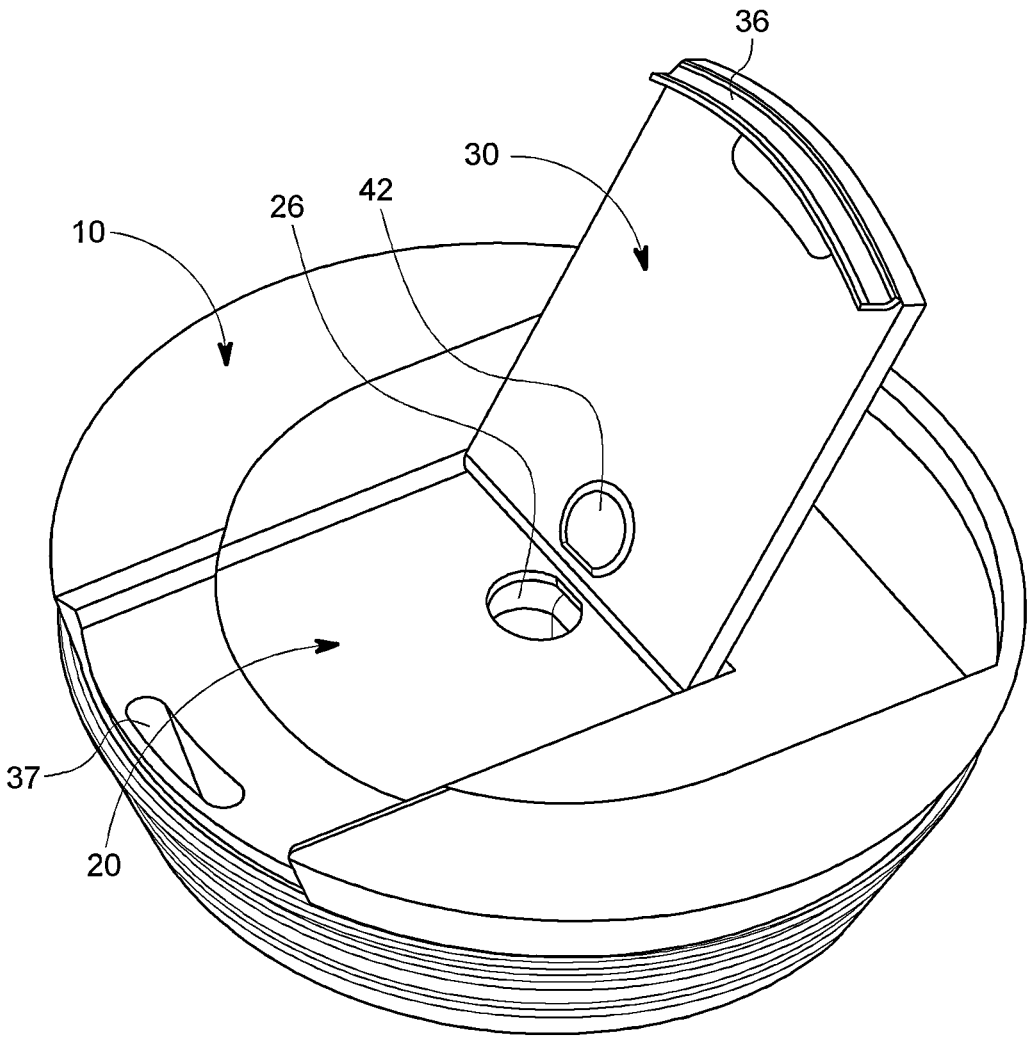
FIG. 7 is a three-dimensional view of the lid of the embodiment according to FIGS. 1 to 6 in its operational state.

FIG. 7 shows the configuration in which, as shown in FIG. 4 in the cross-sectional view, the first closure 20 is closed and the second closure 30 is opened so that the drinking opening 37, as well as the air inlet opening 26 is uncovered.

In the embodiment according to FIGS. 1 to 7, both the first closure 20 and the second closure 30 are pivotally attached. Likewise, it is also possible to attach the second closure 30 in a way such that it can be opening and closed by a translational movement and especially by shifting relative to the lid main body 10 and first closure 20.

Figure 8:
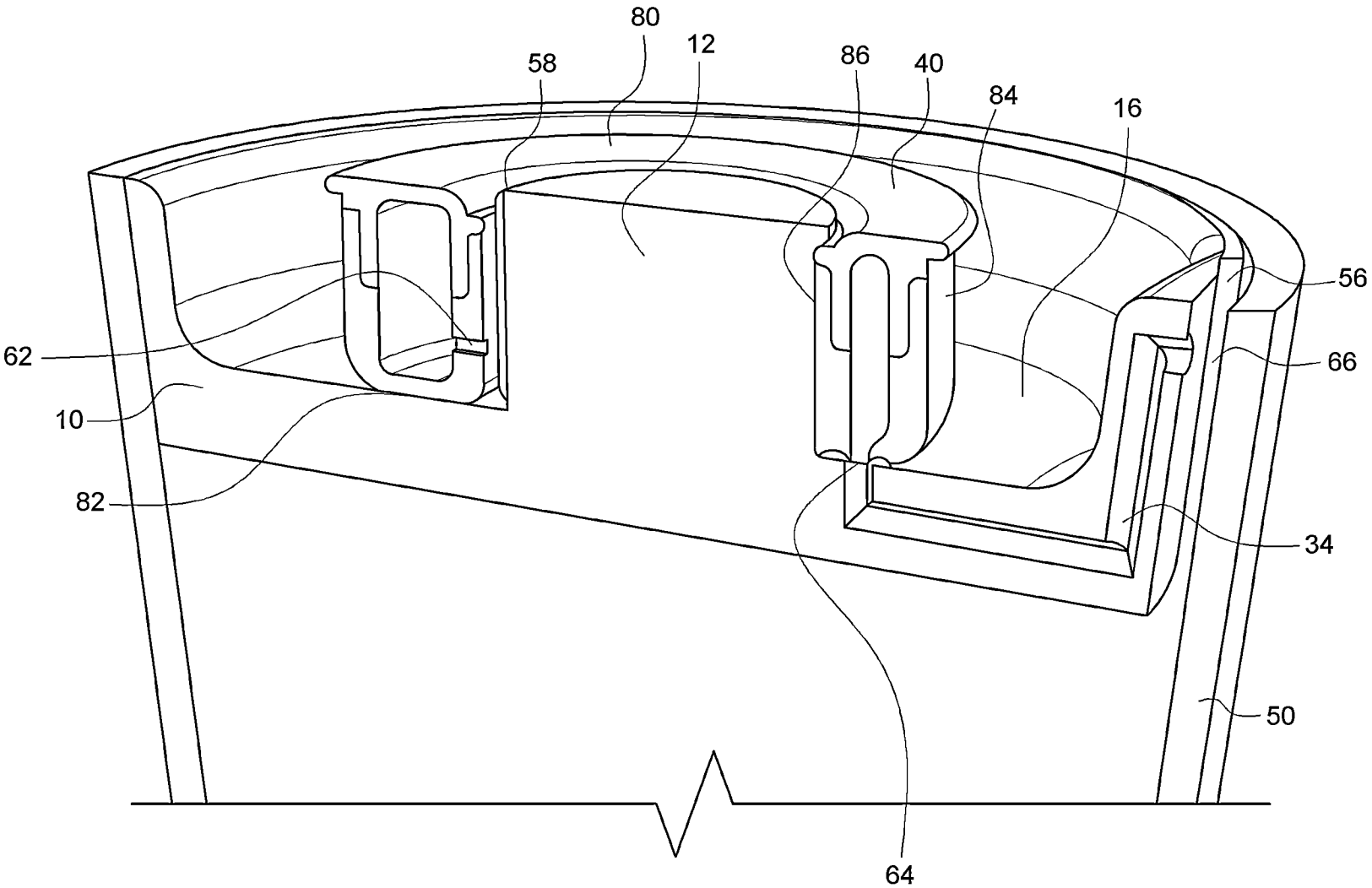
FIG. 8 is a cross-sectional view of the lid of the embodiment of FIGS. 1 to 7 with an alternative air channel arrangement.

FIG. 8 shows a modified version of the system of a lid and an aroma container attached to a drinking vessel of the first embodiment. The upper side of the lid 10 lies in the single plane but the reception space 16 for an aroma container is shaped such that the aroma container 40 is fully received within the reception space 16 so that no matter how the drinking system is held and used, no interference between the aroma container and the user will occur.

As can be seen in the cross-sectional view of FIG. 8, the attachment structure 12 is provided with a channel 58 which allows air to enter into an air inlet opening 62 into the aroma container. The air inlet opening 62 is arranged at the inner circumferential sidewall of the aroma container 40. The channel 58 is only formed once an aroma container has been mounted on the attachment structure. The aroma container is provided with an air outlet opening 64 and enters the aroma channel 34 which leads into a liquid supply channel 66. The liquid supply channel 66 connects the drinking opening 56 with the interior volume of the drinking vessel 50. The air channel 34 is U-shaped so as to minimize the risk of drinking liquid backflowing into the aroma container 40 from liquid transport channel 66.

Figure 9:
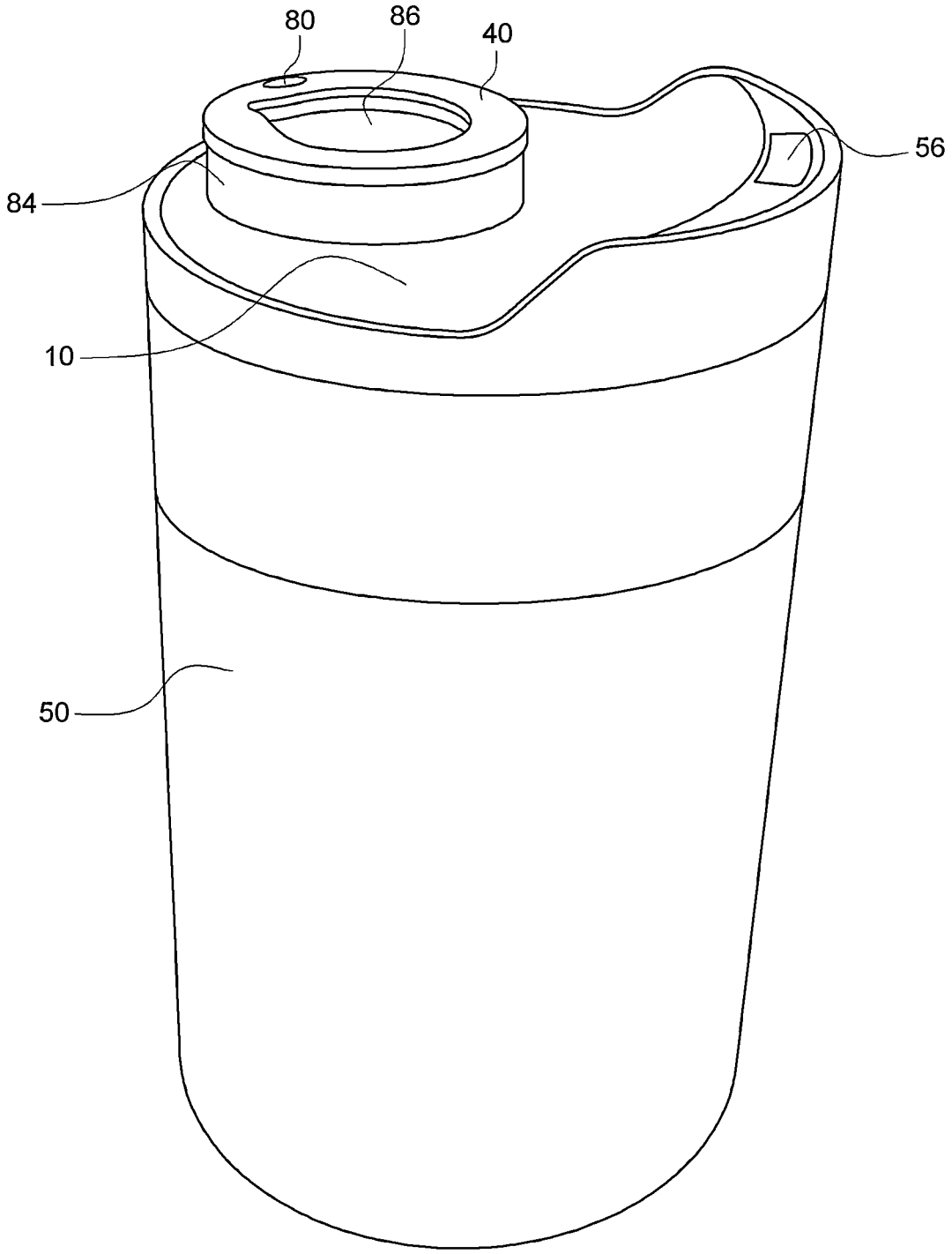
FIG. 9 is a three-dimensional view of the lid of FIGS. 1 to 8 mounted on a drinking vessel.

FIG. 9 shows the inventive system of a lid and an aroma container mounted onto a drinking vessel. In the example of FIG. 9, the lid 10 is provided with a drinking opening 56 so that the drinking vessel according to FIG. 9 is used without a drinking straw. The drinking opening 56 is provided at an elevated position so that a user drinking through the drinking opening can conveniently drink from the drinking system and, even close to the completion of the liquid supply within the vessel 50, the vessel can be tilted and nearly be used upside down without an interference with the aroma container 40 mounted to the lid 10. In the figure, the drinking vessel is shown to be two components. In alternative embodiments, the drinking vessel may be a single component or multiple components can permit an intermediate attachment structure that can further be attached to a number of different sized and shaped drinking vessels that can be convenient for a user for multiple different use case scenarios e.g., so that containers of multiple different shapes and sizes can still be used together with the lid.

Figure 10:
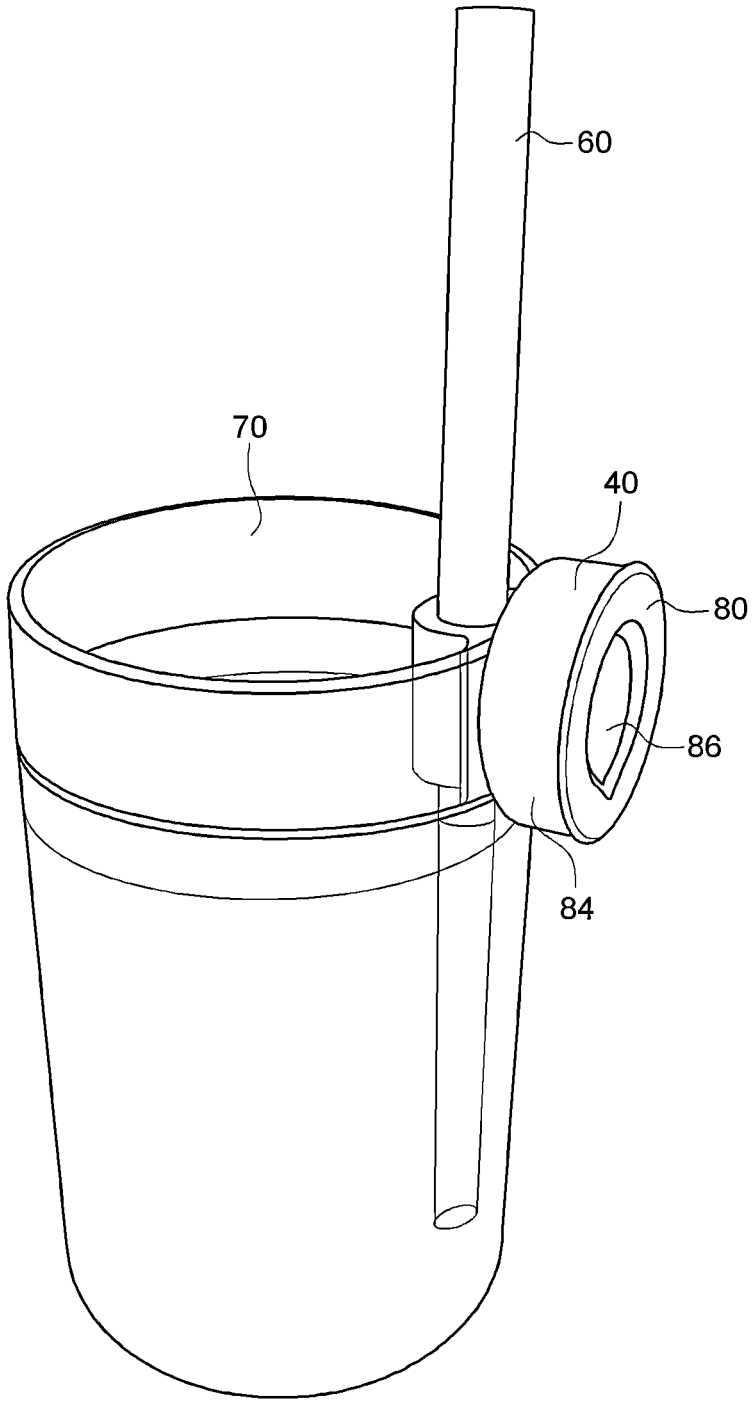
FIG. 10 is a three-dimensional view of a second embodiment of the invention with the lid mounted on a drinking vessel.
Figure 11:
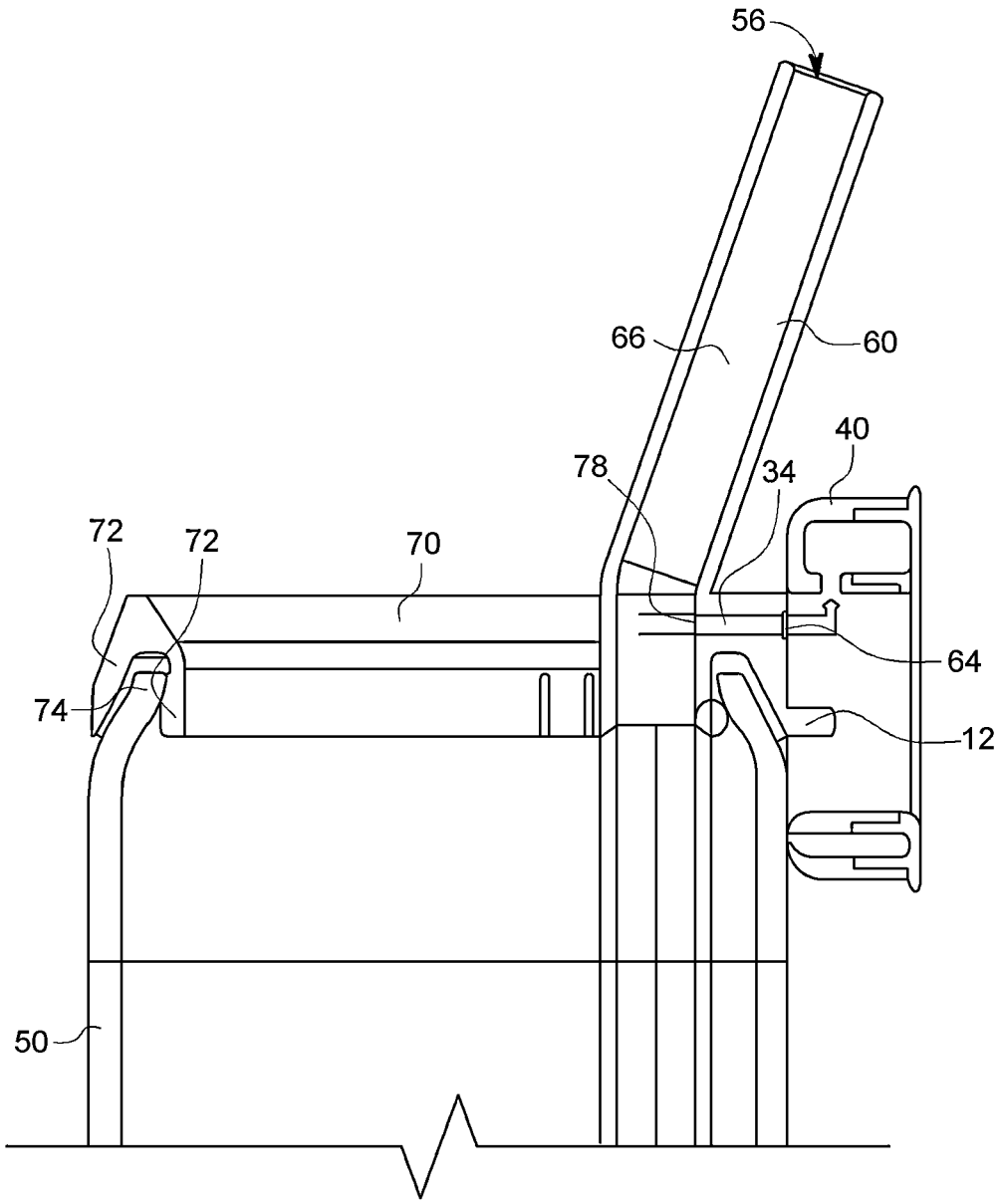
FIG. 11 is a cross-sectional view of the lid according to the second embodiment mounted on a drinking vessel.
Figure 12:
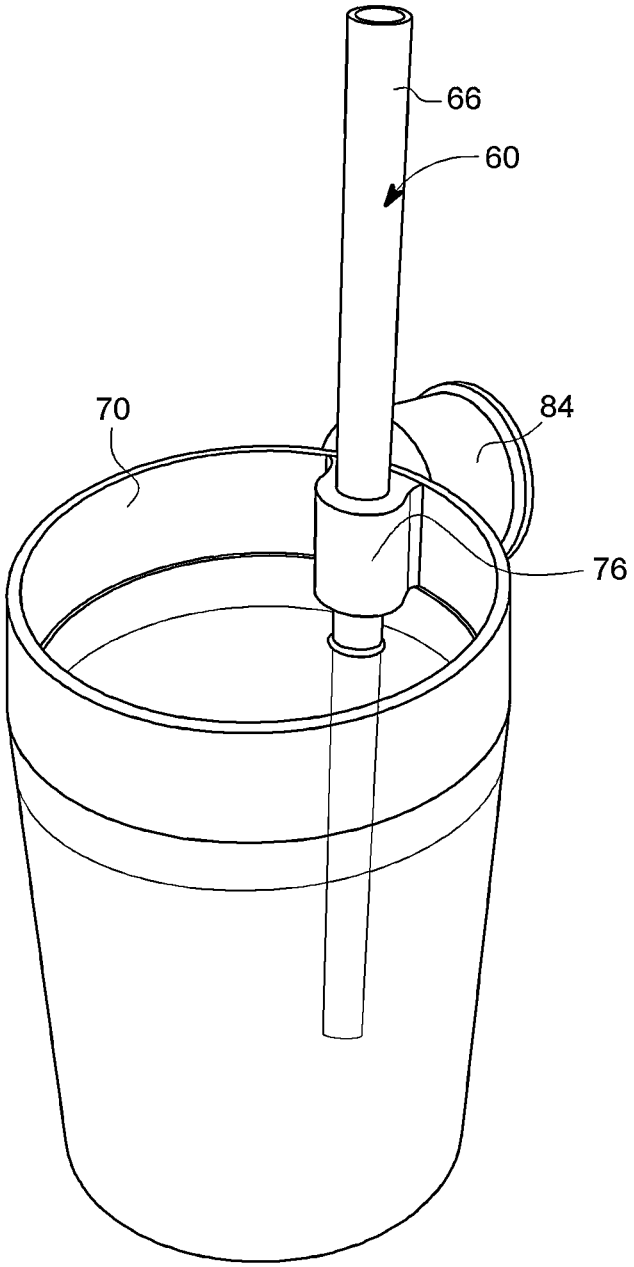
FIG. 12 is a different three-dimensional view of the embodiment according to FIG. 11.

FIGS. 10 to 12 describe a further embodiment of the invention with a system of a lid and an aroma container mounted on a drinking vessel. The lid of this embodiment is a ring 70 which, by means of a suitable mounting structure 72 (see FIG. 11), can be attached to a corresponding upper rim 74 of a drinking vessel 50. As can be seen in the three-dimensional views in FIGS. 10 and 12, the ring 70 is integrally formed with a holding structure 76 which is shaped and adapted to receive and position the drinking straw 60 such that the aroma channel 34 (see FIG. 11) establishes the fluid communication between the air outlet opening 64 of the aroma container 40 and an entry opening 78 into the interior volume of the drinking straw. Attachment means 12 is used to attach the aroma container 40 to the ring 70 such that the air outlet opening 64 of the aroma container is in fluid communication with the aroma channel 34. As can be seen from FIG. 11, the aroma container 40 is arranged in a manner perpendicular to the longitudinal axis of that drinking vessel and attachment and is attached to the side of the attachment. There will be an indent in the side of the drinking vessel and/or attachment or an air inlet opening arranged on the aroma container (none of which are shown in the FIG. 11), such that air is able to enter the aroma container during use. It is to be understood that such a feature is mandatory in order the aroma container and overall system to perform its principal function.

Throughout the embodiments in which the aroma container is shown, the aroma container has a first wall 80, which, is preferably parallel to the first wall, and an outer sidewall 84 and an inner sidewall 86. The inner sidewall 86 and the outer sidewall 84 connect the first wall 80 to the second wall 82. However, different shapes are possible as long as the aroma container is shaped so that an attachment structure can be designed for attaching the aroma container to the lid.

Figure 13:
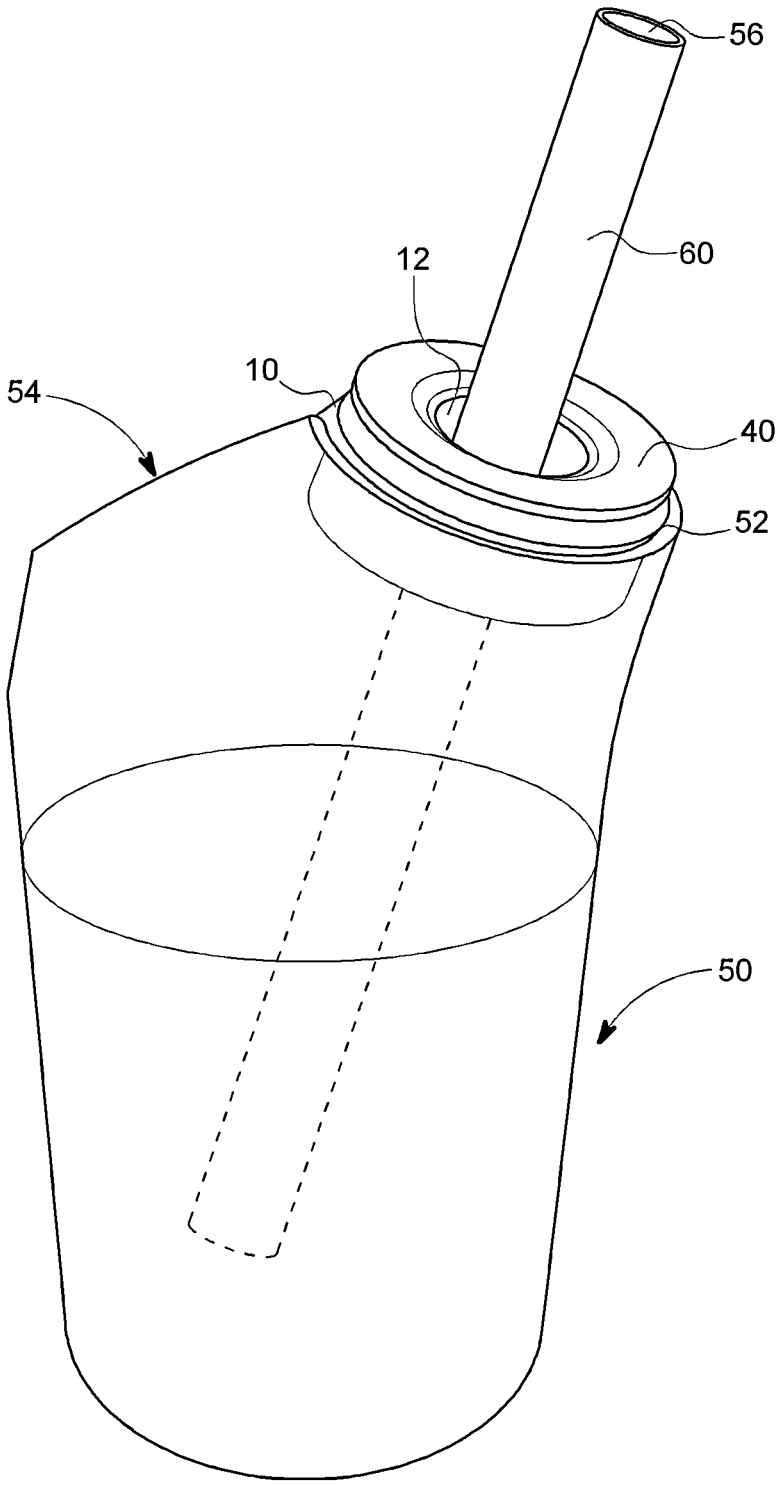
FIG. 13 is a three-dimensional view of a third embodiment of the invention with a lid mounted onto a drinking vessel.

FIG. 13 shows a third embodiment of the inventive system of an attachment and an aroma container attached to an opening 52 of a drinking vessel 50. The attachment structure consists of a lid main body 10 with an attachment structure 12 for an aroma container 40. Further, a drinking straw 60 is inserted through a receiving channel of the attachment structure 12 and into the interior volume of the drinking vessel 50.

The drinking vessel 50 can have any suitable shape. In the embodiment according to FIG. 8, a second opening 54 of the drinking vessel 50 can be provided so that a user can decide whether they want to drink liquid directly from the drinking vessel 50 or through the straw 60 supplemented with aromatized air. This enables the user to conveniently be able to drink non-flavoured water without needing to first deactivate the aroma container. Thus, the drinking vessel 50 in the embodiment shown contains two openings, which can be of the same or different sizes—or can be one single opening shaped in a figure of eight (hollow lemniscate shape). The attachment device is any suitable attachment which slots suitably into one of the openings in the drinking vessel and supports the drinking straw 60 and aroma container 40, enabling air to flow through the aroma container and become aromatized/flavoured air which can enter into a liquid transport channel of the straw—in the same manner as known scent based taste drinking devices and as described in relation to the other embodiments presented herein.

The invention claimed is:

1. A drinking system comprising a lid and an aroma container, wherein the lid is attachable to the opening of a drinking vessel having an interior volume for a drinking liquid, wherein the lid includes: a transport channel configured to transport the drinking liquid to a drinking opening; and an attachment structure configured to attach the aroma container to the lid;

wherein the aroma container includes:

a first wall, a second wall essentially parallel to the first wall, at least one sidewall connecting the first wall and the second wall, an air inlet opening and an air outlet opening; and wherein the lid includes an aroma channel with a first end and a second end, the aroma channel being arranged and configured such that aromatized air leaving the air outlet opening of the aroma container enters the aroma channel through the first end, and leaves the aroma channel through the second end, the second end of the aroma channel being in communication with an opening into the transport channel for the drinking liquid.

2. The drinking system according to claim 1, wherein the lid further includes a second aroma channel, the second aroma channel having a first end for the inlet of air from the surroundings and a second end being in communication with the air inlet opening of the aroma container.

3. The drinking system according to claim 2, wherein the first aroma channel is arranged in a main body part of the lid.

4. The drinking system according to claim 2, wherein the first and second aroma channels are arranged substantially parallel to one another.

5. The drinking system according to claim 1, wherein the lid has a single opening configured to permit liquid to exit the drinking vessel.

6. The drinking system according to claim 1, wherein the aroma container has an outer sidewall and an inner sidewall adapted to a shape of the attachment structure of the lid, wherein in the attached state of the aroma container on the lid the attachment structure extends through a space surrounded by the inner sidewall.

7. The drinking system according to claim 6, wherein the air inlet opening is arranged on the inner sidewall of the aroma container and the air outlet opening is arranged on the second wall which is located on the underside of the aroma container when in the attached state.

8. The drinking system according to claim 7, wherein the attachment structure includes a fixing protrusion, wherein in the attached state of the aroma container on the fixing protrusion, there is an air duct is formed between the fixing protrusion and the inner sidewall of the aroma container, the air duct being in communication with the air inlet opening and the outside atmosphere.

9. The drinking system according to claim 1, wherein the attachment structure includes a receiving channel for the inlet of air from the surrounding atmosphere to the air inlet opening of the aroma container.

10. The drinking system according to claim 9, wherein the lid further includes a first closure having a main body with an air inlet opening, the first closure being moveably attached to the lid main body and being moveable between an open position and a closed position in which the first closure covers the aroma container such that the receiving channel is aligned with the air inlet opening.

11. The drinking system according to claim 10, wherein the lid further includes a second closure moveably connected to the lid, such that the second closure is moveable between a closed position and an open position.

12. The drinking system according to claim 11, wherein the second closure further includes a plug configured to simultaneously block the receiving channel in the closed position.

13. The drinking system according to claim 1, wherein the lid includes a lid connection constructed and arranged to attach the lid to the opening of the drinking vessel, wherein the transport channel is located at or proximal to the lid connection.

14. The drinking system according to claim 1, wherein the lid is attachable to drinking vessels with different sizes of vessel opening.

15. A drinking device comprising a drinking vessel attached to the drinking system according to claim 1.

16. The drinking system according to claim 3, wherein the second aroma channel is arranged in the attachment structure of the lid.

17. The system drinking according to claim 4, wherein the first and second aroma channels are arranged substantially in the same horizontal plane as one another.

18. The drinking system according to claim 11, wherein the second closure further includes a distal lip configured to block the drinking opening in the closed position.

19. The drinking system according to claim 13, wherein the entire transport channel is located proximal to the lid connection.

* * * * *